United States Patent [19]

Smith

[11] Patent Number: 4,747,490

[45] Date of Patent: May 31, 1988

[54] COOLER-GOLF CLUB CARRIER

[76] Inventor: Fred Smith, 1830 Clark St., Long Beach, Calif. 90815

[21] Appl. No.: 934,544

[22] Filed: Nov. 24, 1986

[51] Int. Cl.[4] ..... A45C 11/20; B65D 85/20; A63B 55/10

[52] U.S. Cl. ..... 206/542; 206/541; 206/315.1; 206/315.2; 206/315.11; 190/102; 220/85 R

[58] Field of Search ..... 206/541, 542, 315.1, 206/315.2, 315.3, 579; 150/526, 106, 104, 105; 211/70.2; 190/102; 248/96, 231.8, 316.7; 220/85 R

[56] References Cited

U.S. PATENT DOCUMENTS

| | | | |
|---|---|---|---|
| 2,319,729 | 5/1943 | Ford | 190/102 |
| 2,683,478 | 7/1954 | Seelig | 150/109 |
| 3,215,181 | 11/1965 | Reed | 206/315.2 X |
| 3,503,518 | 3/1970 | Black | 211/70.2 |
| 4,353,182 | 10/1982 | Jurkas et al. | 206/315.11 X |
| 4,388,967 | 6/1983 | Breese | 248/316.7 X |
| 4,640,392 | 2/1987 | Decker Jr. et al. | 206/541 X |
| 4,666,038 | 5/1987 | Minneman | 206/315.2 |

*Primary Examiner*—Stephen Marcus
*Assistant Examiner*—T. Graveline
*Attorney, Agent, or Firm*—Michael Bak-Boychuk

[57] ABSTRACT

An attachment for a prior art beverage carrier includes rows of cantelevered clips for securing golf clubs. The attachment is provided with retaining devices for engaging the carrier handle and is thus selectively mounted thereon. Spaced adjacent the retaining devices, in longitudinal displacement, are further panels for supporting golf paraphenalia. In the alternative, the elements for securing golf items are separately fixed to the carrier.

3 Claims, 2 Drawing Sheets

FIG. 1
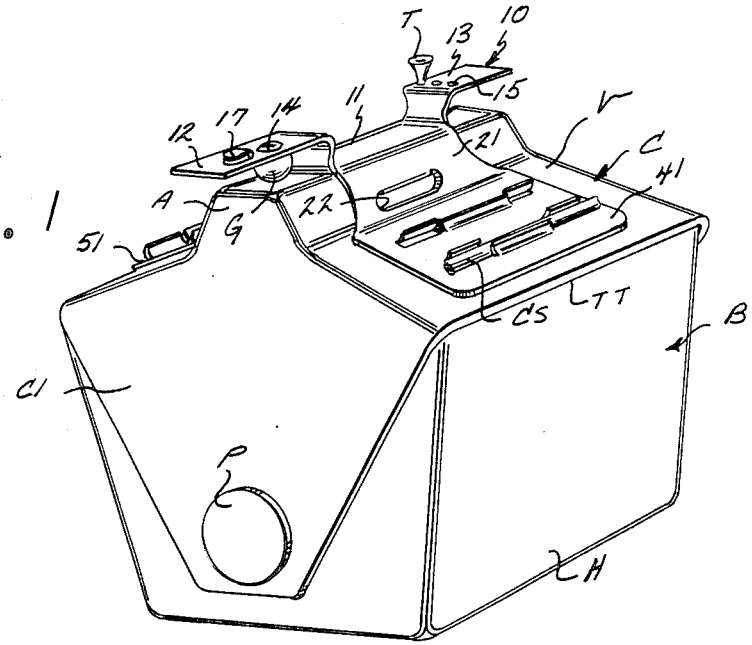
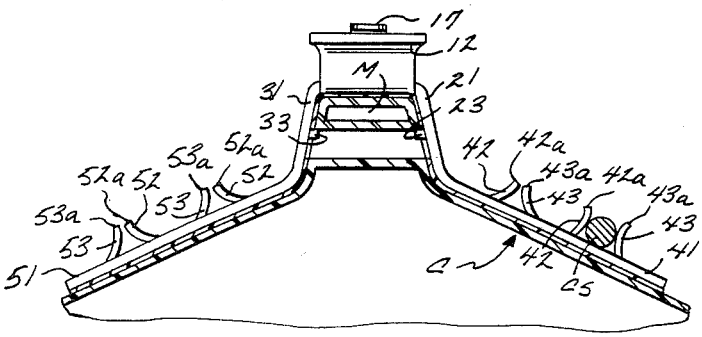
FIG. 2
FIG. 3
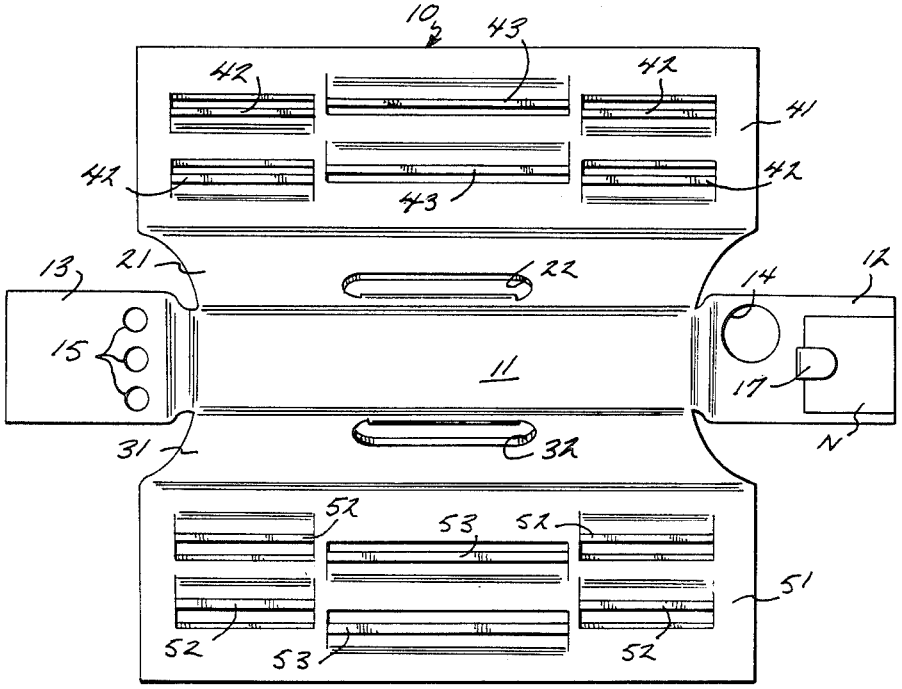

COOLER-GOLF CLUB CARRIER

BACKGROUND OF THE INVENTION

1. Field of the Invention

The present invention relates to golf club carriers and, more particularly, to club carriers which also store beverages and the like.

2. Description of the Prior Art

The transport of the articles necessary for playing golf has had various implementations. The more recent club carriers take the form of a clamping device of two or more articulated pieces between which the clubs are retained. The clamping structure is then fixed to a pedestal or mount which sometimes collapses for transport.

Alternatively, golf clubs have been carried in a golf bag, in a vertical array, particularly when a full complement of clubs is used.

In each foregoing instance the carrying device forms an added structure of necessity carried by the player, thus limiting transport of any other conveniences in the course of play.

Quite often a player will elect to engage in the game with a limited selection of clubs. For example, the particular golf course played may be suited for short irons only, or the player may habitually prefer only certain favorite clubs. In such instances the prior carrying devices exceed the requirements of the player without providing storage convenience for items not related to the game of golf.

Consequently, golf club carriers which also accommodate other incidental articles of use are desired and it is one such carrier that is disclosed herein.

SUMMARY OF THE INVENTION

Accordingly, it is the general purpose and object of the present invention to provide a carrier assembly conformed as a beverage container housing including mounting provisions for retaining golf clubs.

Other objects of the invention are to provide a modification to a beverage carrier for storing articles useful in playing golf.

Yet additional objects of the invention are to provide a container carrier conformed for storing golf clubs.

Briefly, these and other objects are accomplished within the present invention by providing a convolved surface attachment conformed to engage the pivotal cover of an insulated beverage carrier of the type sold by Igloo, Inc. under the mark, style or designation "Playmate". The attachment may be formed as a sheet plastic structure generally of a V-shape including a central convolution shaped to receive the handle of the beverage carrier. Formed at the ends of the handle convolution are two, flat surfaces, one provided with ball and note pad clips and the other with perforations for receipt of golf tees. The side surfaces extending on either of the central convolution include longitudinal spring tabs for receiving the shafts of the golf clubs. In this form the surface attachment may be fixed to the pivotal cover of the carrier in engagement with the handle thereon to provide convenient storage of the implements of golf.

Alternatively, the pivotal cover may be modified to include longitudinal channel segments on either side of the handle and flat surfaces at the handle ends for effecting the storage of clubs, tees and golf balls thereon.

BRIEF DESCRIPTION OF THE DRAWINGS

FIG. 1 is a perspective illustration of an inventive golf club carrier attachment affixed to a prior art container;

FIG. 2 is a front view of the carrier attachment shown in FIG. 1;

FIG. 3 is a top view of the carrier attachment shown in FIG. 1;

DESCRIPTION OF THE SPECIFIC EMBODIMENT

Figure 4:
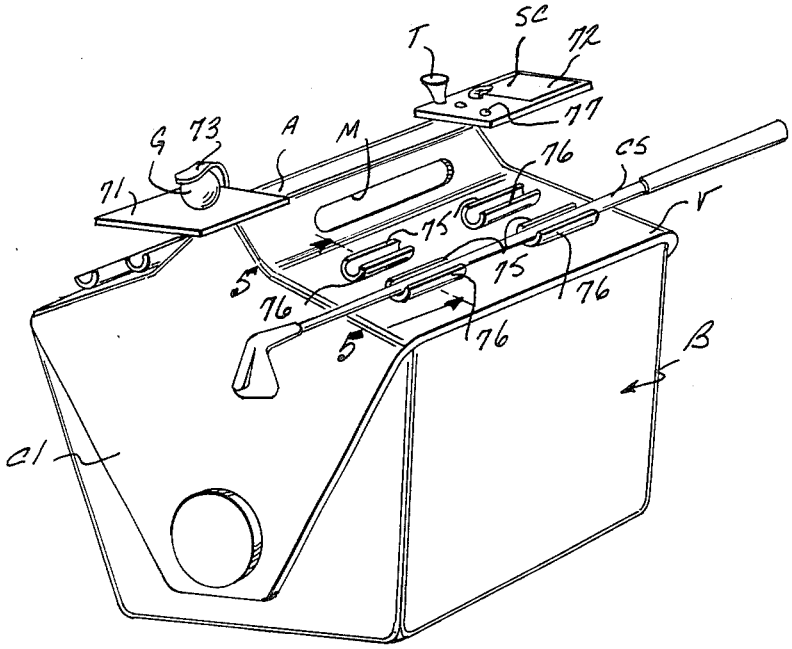
FIG. 4 is yet another perspective illustration of a container modified in accordance with the present invention.

As shown in FIGS. 1 through 3, a prior art beverage carrier B of the type sold by Igloo, Inc. under Model or make "Playmate" includes a rectangular, insulated, hollow housing H provided with a front (and rear) pivot pin P extending longitudinally from the end surfaces thereof. These pivot pins then fix for rotation an articulated cover C generally defined by two pivotal end plates C1 and C2 at the ends of a V-shaped cover plate V which, in one pivotal position, spans across the top opening TT of the housing H. For manual convenience cover plate V is provided with a handle M at its apex A.

In this form the beverage carrier B forms a storage cavity in which chilled food and beverages may be stored and which is comfortably carried by a user.

To convert this beverage carrier for use in storing golfing equipment, a convolved sheet structure adaptor, generally at number 10, is provided including a central element 11 of generally rectangular shape joined to two offset planar tabs 12 and 13 at the longitudinal ends thereof. Tab 12 may be provided with one or more circular openings 14 each of a diameter less than the diameter of a golf ball G, preferably a diameter determined by the ball chord section at the offset of the tab. The other tab 13 may be provided with a row of openings 15 each of a diameter equal to the shank section of a golf tee T. Formed adjacent the row of openings 15 is an offset clip 17 useful in retaining a notepad N on the tab surface.

The longitudinal edges of the central element 11 are respectively joined to two lateral bent over segments 21 and 31 each provided with a cutout 22 and 32 corresponding to the opening subjacent handle M, each said cutout 22 and 32 including an engagement lip 23 and 33 in opposed presentation of the edges proximate the central element 11 for grasping the underside of the handle. Segments 21 and 31 at their distal edges then join inclined surfaces 41 and 51 aligned at angular displacement to mate with the angular alignment of the cover plate V for adhesive bonding shown at 50.

Thus, when the engagement lips 23 and 33 are pressed onto handle M the inclined surfaces 41 and 51 will align on top of plate V and are consequently available to support an array of clubs. More specifically, each surface 41 and 51 is pierced to form rows of first louver tabs 42 and 52 in the form of inclined surface clips having rows of second louver tabs 43 and 53 interspaced therebetween and aligned at an opposite inclination. Each said louver tab 42, 43, 52 and 53 includes curled free edges **42*a*, 43*a*, 52*a* and 53*a* the spacing between edges 42*a* and 52*a* and 43*a* and 5*a*** being less than the diameter of a club shaft CS. Accordingly, clubs may be retained for storage between the interspaced louver tabs and may be pulled out against the tab spring tension when required for use. The beverage carrier thus implemented is then useful to store articles entailed in the game of golf without any loss of the original functions.

Figure 5:
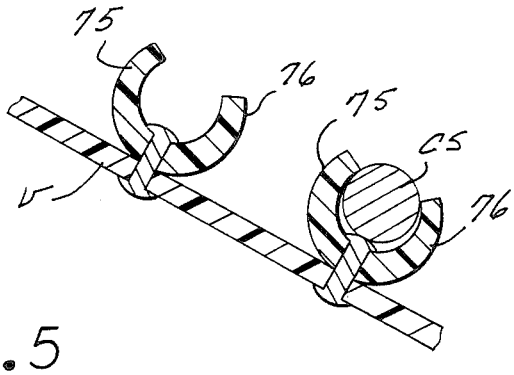
FIG. 5 is a sectional view taken along line 5—5 of FIG. 4.

As shown in FIGS. 4 and 5, an alternative implementation of similar features may be achieved by direct attachment of structures to the coverplate V. More specifically, two planar elements 71 and 72 may be fixed to the apex A of the cover plate at the ends of handle M, the first including a clip structure 73 for retaining golf balls G. The second element 72 may include a row of openings 77, similar to openings 15 and an offset clip 74 for securing a scorecard SC. The exterior surface of the cover plate V may then secure segments 76 of a C-sectioned extrusion, each presenting a gap 75 of a dimension smaller than the diameter of the shaft CS. In this form the prior art carrier B is reconfigured for storing articles of golf play in a manner which is both convenient and inexpensive.

Of course, various material structures may be useful with the invention herein, the selection being based mainly on the elastic characteristics of the material necessary for the insertion and removal of articles. Thus, the attachment 10 may be formed from sheet metal or any one of the substantially rigid polymers with similar material selections being useful in segments 76.

Obviously many modifications and changes may be made to the foregoing without departing from the spirit of the invention. It is therefore intended that the scope of the invention be determined solely on the claims appended hereto.

What is claimed is:

1. In a beverage carrier characterized by a rectangular housing pivotally engaged to a N-shaped cover conformed for pivotal translation into alignment over a top opening in said housing, said cover including a handle proximate the apex thereof, the improvement comprising;

a convolved sheet structure adhesively secured to said cover and conformed for mating alignment on said cover and including a central convolution adapted to receive said apex and to engage said handle and lateral surfaces formed on either said of said central convolution each including rows of cantelevered spring tabs inclined towards each other and spaced for releasably receiving golf clubs therebetween.

2. Apparatus in accordance with claim 1, further comprising:

a first and second platform formed at the longitudinal ends of said central convolution, said first platform including an offset clip in the surface thereof.

3. In a beverage carrier characterized by a rectangular housing pivotally engaged to a V-shaped cover conformed for pivotal translation into alignment over a top opening in said housing, said cover including a handle proximate the apex thereof, the improvement comprising:

a plurality of C-shaped elastomeric segments affixed in rows to said cover and aligned to present a gap therein for receiving golf clubs; and a first and second platform fixed to said apex in spaced relationship with said handle.

* * * * *